US005833230A

United States Patent [19]

Nakagawa et al.

[11] Patent Number: 5,833,230

[45] Date of Patent: Nov. 10, 1998

[54] SHEET SUPPLYING APPARATUS WITH CENTRALLY DISPOSED FEEDING FORCE

[75] Inventors: Tomohito Nakagawa, Tokyo; Noriyoshi Ueda, Yokohama, both of Japan

[73] Assignee: Canon Kabushiki Kaisha, Tokyo, Japan

[21] Appl. No.: 703,074

[22] Filed: Aug. 26, 1996

[30] Foreign Application Priority Data

Aug. 28, 1995 [JP] Japan ..... 7-218645

[51] Int. Cl.[6] ..... B65H 3/52

[52] U.S. Cl. ..... 271/121; 271/188; 271/272; 271/122; 271/124; 271/125

[58] Field of Search ..... 271/188, 121, 271/124, 272, 122, 125

[56] References Cited

U.S. PATENT DOCUMENTS 4,216,952 8/1980 McInerny ..... 271/10
4,705,265 11/1987 Hirota et al. ..... 271/122
4,779,861 10/1988 Ozawa ..... 271/119
5,105,225 4/1992 Honjo et al. .
5,163,672 11/1992 Mennie ..... 271/187
5,181,705 1/1993 Ueda et al. .
5,295,675 3/1994 Hain ..... 271/12
5,455,667 10/1995 Hiroi et al. .
5,552,859 9/1996 Nakagawa et al. .
5,579,083 11/1996 Naito et al. .

*Primary Examiner*—William E. Terrell
*Assistant Examiner*—Joe Dillon, Jr.
*Attorney, Agent, or Firm*—Fitzpatrick, Cella, Harper & Scinto

[57] ABSTRACT

A sheet supplying apparatus has a sheet separator for separating and feeding sheets one by one. The separator is formed of a plurality of separation portions each including a sheet supply roller rotated in a sheet feeding direction and a sheet return roller rotated in a direction opposite to the sheet feeding direction, each disposed along a width-wise direction of the sheet. A sheet supplying force of a central separation portion disposed substantially at a center of the sheet in the width-wise direction is selected to be greater than that of the other separation portions.

16 Claims, 17 Drawing Sheets

SHEET SUPPLYING APPARATUS WITH CENTRALLY DISPOSED FEEDING FORCE

BACKGROUND OF THE INVENTION

1. Field of the Invention

The present invention relates to a sheet supplying apparatus applicable to an image forming apparatus such as a copying machine, a laser beam printer and the like, and an image forming apparatus using such a sheet supplying apparatus.

2. Related Background Art

In conventional automatic original supplying apparatus for automatically supplying to an image reading portion of an image forming apparatus such as a copying machine, a plurality of originals (sheets) stacked on an original stacking plate are separated and supplied one by one means of a separation portion.

FIG. 21 is a sectional view showing an example of such a separation portion. In the separation portion, when a retractable shutter 203 against which a sheet stack P can abut is retarded or retracted from a tray 201 to a position shown by the broken line, a semicircular pick-up roller 202 which can be rotated in an anti-clockwise direction and a weight van or plate 204 for urging the pick-up roller 202 are urged against the sheet stack P on the tray 201 in order to supply a sheet P one by one from a lowermost one toward a sheet supplying direction (shown by the arrow 214). Separation/supply rollers 206 are slightly overlapped with separation belts at areas 212, and, as shown in FIG. 22, the separation belts 208 disposed alternately with the separation/supply rollers 206 are wound around and mounted on separation drive pulleys 207 and separation driven pulleys 209. The separation drive rollers are secured to a separation belt drive shaft 211 to which a driving force is transmitted from a drive motor (not shown) through a drive transmission means (not shown) such as gears. By rotating the separation drive pulleys 207 in an anti-clockwise direction, the separation belts 208 act on the sheets in a direction opposite to a sheet supplying direction, thereby preventing the supplying of second and other sheets. Incidentally, the separation driven pulleys 209 are rotatably supported on a separation driven shaft 210 so that, when the separation belts 208 are rotated, the separation driven pulleys 209 are rotatingly driven together with the separation belts. The reference numeral 205 denotes regulating plates for guiding the sheet at areas out of the separation belts 208.

Since the separation/supply roller 206 has an outer peripheral surface made of rubber having a coefficient of friction greater than those of the separation belts 208 and a peripheral speed of the roller 206 is slightly faster than those of the separation belts 208, only the lowermost sheet can be supplied while preventing the supplying of the second and other sheets. Although a sheet supplying force is proportional to an amount of the overlap between the separation/supply roller 206 and the separation belts 208, if the overlap amount is too great, there will arise undulation in sheet between the separation/supply roller 206 and the separation belts 208 to increase a supplying load, thereby causing the poor sheet supply. On the other hand, if the overlap amount is too small, the supplying of the second and other sheets cannot be prevented, thereby causing double-feed of sheets. Thus, the overlap amount is generally selected to about 0.2 to 0.5 mm.

Further, as shown, to cope with various sheet sizes and various sheet thickness, a plurality of separation belts 208 and separation/supply rollers 206 are disposed substantially symmetrically with respect to a center line 213 of the sheet, and three pairs of separation elements (two separation belts 208 and three separation/supply rollers 206) in which distances between the separation belts 208 and the separation/supply rollers 206 are short are provided (this is an example of pairs of separation elements among various conventional pairs).

However, in the above-mentioned conventional case, since the sheet P is outputted from an image forming apparatus such as a color copying machine, a color printer or the like, regarding an image (unbalanced image) including a thick image portion (such as a dense image) copied on an upper area A above the center line 213 of the sheet and a thin image portion (such as characters) copied on a lower area B as shown in FIG. 23, since the area A having the thick image is covered by toner substantially entirely and is coated by the fixing silicone oil, the coefficient of friction of the area is extremely low; whereas, in the area B having the larger surface of the sheet itself, since the fixing silicone oil is absorbed to the texture of the sheet, the coefficient of friction of the area B becomes considerably greater than that of the area A.

When the sheet having such a feature is supplied by the above-mentioned conventional separation means, the area A of the sheet is gripped by the uppermost (FIG. 22) pair of separation elements (among three pairs of separation elements). In this case, due to the presence of the silicone oil on the sheet surface, the area A of the sheet is slipped with respect to the uppermost pair of separation elements more or less, with the result that a convey amount of the area A becomes smaller than that of the area B gripped by the remaining two pairs of separation elements, thereby causing the skew-feed of sheet, which leads in the sheet jam.

SUMMARY OF THE INVENTION

An object of the present invention is to provide a sheet supplying apparatus which can surely separate and supply sheets one by one without causing the skew-feed of sheet regardless of a condition of an image formed on the sheet.

To achieve the above object, according to the present invention, there is provided a sheet supplying apparatus having a sheet separation means for separating and feeding sheets one by one and wherein the separation means comprises a plurality of separation portions each including a sheet supply means rotated in a sheet feeding direction and a sheet return means rotated in a direction opposite to the sheet feeding direction, which separation portions are disposed along a width-wise direction of the sheet, and a sheet supplying force of a central separation portion disposed substantially at a center of the sheet in the width-wise direction is selected to be greater than those of the other separation portions.

DETAILED DESCRIPTION OF THE PREFERRED EMBODIMENTS (First Embodiment)

Figure 2:
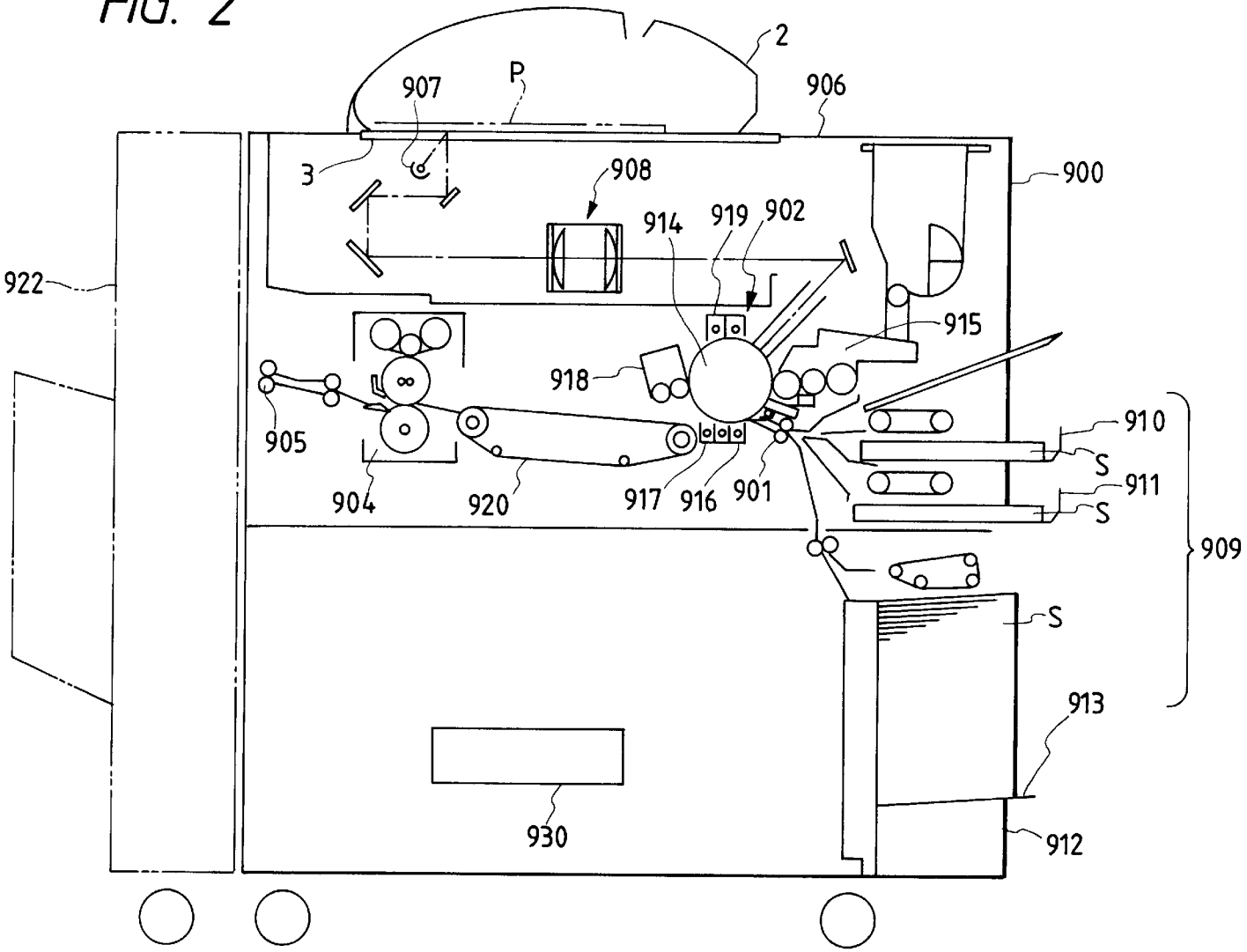
FIG. 2 is a sectional view of an image forming apparatus having the automatic original feeding apparatus of FIG. 1.

The present invention will now be explained in connection with embodiments thereof with reference to the accompanying drawings. FIG. 2 shows an example of an image forming apparatus (copying machine) to which a sheet supplying apparatus or an automatic original supplying apparatus according to the present invention can be applied.

The copying machine 900 comprises a platen glass 3 acting as an original reading portion, a light source (reading means) 907, a lens system 908, a sheet supply portion 909, and an image forming portion 902. An original from an automatic original supplying apparatus is supplied to the platen glass 3 one by one. The sheet supply portion 909 includes cassettes 910 and 911 which contain sheets and which can be removably mounted to the copying machine 900, and a deck 913 disposed on a pedestal 912. The image forming portion 902 includes a cylindrical photosensitive drum 914, a developing device 915, a transfer charger 916, a separation charger 917, a cleaner 918, and a first charger 919. A convey device 920, a fixing device 904 and discharge rollers 905 are disposed at a downstream side of the image forming portion 902.

The sheets S discharged from the copying machine are sorted by a sheet sorting apparatus 922 connected to the copying machine 900, if necessary. The reference numeral 930 denotes a control device (CPU) of the copying machine 900.

Next, an operation of the image forming apparatus (copying machine) will be explained.

When a sheet supplying signal is emitted form the control device 930 of the copying machine 900, the sheet S is supplied form the cassettes 910, 911 or the deck 913. On the other hand, light emitted from the light source 907 is incident on an original P rested on the platen glass 3, and light reflected from the original is illuminated onto the photosensitive drum 914 through the optical system 908. The photosensitive drum 914 was previously charged by the first charger 919. Thus, when the light is illuminated onto the photosensitive drum, an electrostatic latent image is formed on the drum, and then, the latent image is developed by the developing device 915 to form a toner image.

The sheet S supplied from the sheet supply portion 909 is sent to a pair of regist rollers 901, where skew-feed of sheet is corrected. Then, the sheet is sent to the image forming portion at a predetermined timing. In the image forming portion 902, the toner image on the photosensitive drum 914 is transferred onto the sheet S by means of the transfer charger 916. The sheet S to which the toner image was transferred is charged with polarity opposite to that of the transfer charger 916 by means of the separation charger 917, with the result that the sheet is separated from the photosensitive drum 914. The separated sheet S is sent, by the convey device 920, to the fixing device 904, where the transferred toner image is permanently fixed to the sheet S. The sheet to which the toner image was fixed is discharged out of the copying machine 900 by means of the discharge rollers 905. In this way, the sheet S supplied from the sheet supply portion 909 is discharged after the image was formed on the sheet.

Next, the automatic original supplying apparatus according to the present invention will be explained.

Figure 1:
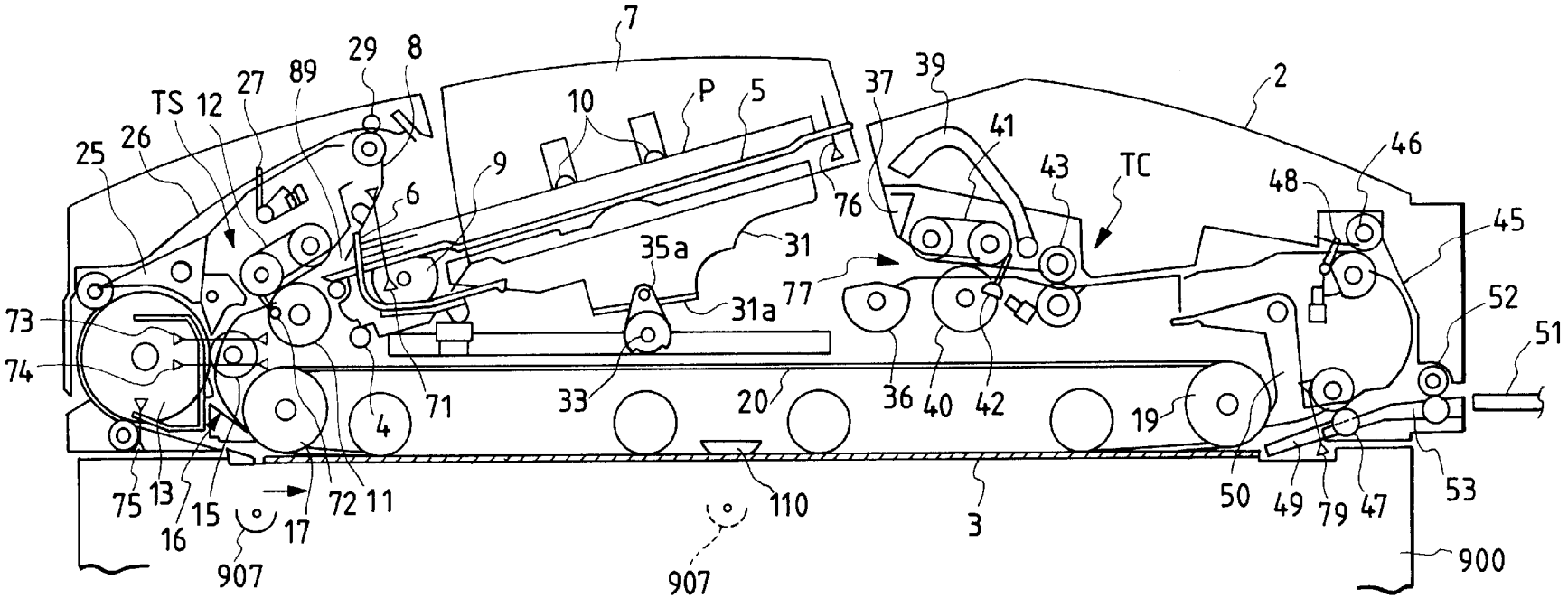
FIG. 1 is a sectional view of an automatic original feeding apparatus having a sheet supplying apparatus according to the present invention.

FIG. 1 is a sectional view of the automatic original supplying apparatus 2. In FIG. 1, a reversible convey belt (endless belt) 20 wound around and mounted on a drive roller 17 and a driven roller 19 is disposed on the platen glass 3 of the copying machine 900.

The plurality of originals P are stacked on an original stacking plate 5, and the originals are aligned with each other by a pair of width regulating plates 7. A recycle lever 10 rested on the original stack P serves to separate the non-read originals from the originals which were supplied and are returned onto the original stacking plate 5. A shutter (shift means) 6 serves to support tip ends of the originals to align the originals with each other and can be retracted or retarded below the original stacking plate 5 upon the supplying of original. A semi-circular feed-out roller 9 is rotated to feed the original(s) from the lowermost one in the original supplying operation. A lift/lower urging member 8 serves to urge the original stack P against the feed-out roller 9.

At a downstream side of the feed-out roller 9, there are disposed a plurality of separation portions each including a convey roller 11 rotated in an original supplying direction and a separation belt 12 rotated in an original returning direction, which separation portions serve to separate and convey the originals P (fed out by the feed-out roller 9) one by one. A pair of regist rollers 13, 15 comprised of a reverse rotation roller 13 and a driven roller 15 urged against the reverse rotation roller are disposed at a downstream side of the separation portions, which regist rollers serve to supply the original P onto the platen glass 3 at a predetermined timing. Regarding the original P conveyed by the convey belt 20 and stopped on the platen glass 3 at a predetermined position, stationary-reading is effected by shifting the light source 907 in a direction shown by the arrow, thereby an image on the original is read.

A convey path including the separation portions 11, 12 and the pair of regist rollers 13, 15 constitutes a first convey path 16. Further, the first convey path 16, convey belt 20 and discharge path 26 constitute switch-back path TS for conveying the original P to a reading position in a switch-back fashion and for discharging the original.

After the stationary reading is finished, the original P is conveyed to a flapper 25 through a convey path disposed outside the reverse rotation roller 13 by reversely rotating the convey belt 20. The flapper 25 serves to reversely rotate (turn up) the original P and then guide it to the platen glass 3 in a both-face reading mode or to guide the original to a pair of discharge rollers 29 through the discharge path 26 in a single-face reading mode. The reference numeral 27 denotes a sensor for detecting the original P passing through the discharge path 26. The original P discharged by the pair of discharge rollers 29 is rested on the non-supplied original stack P on the original stacking plate 5 and is distinguished from the non-supplied originals by the recycle lever 10.

Figure 3:
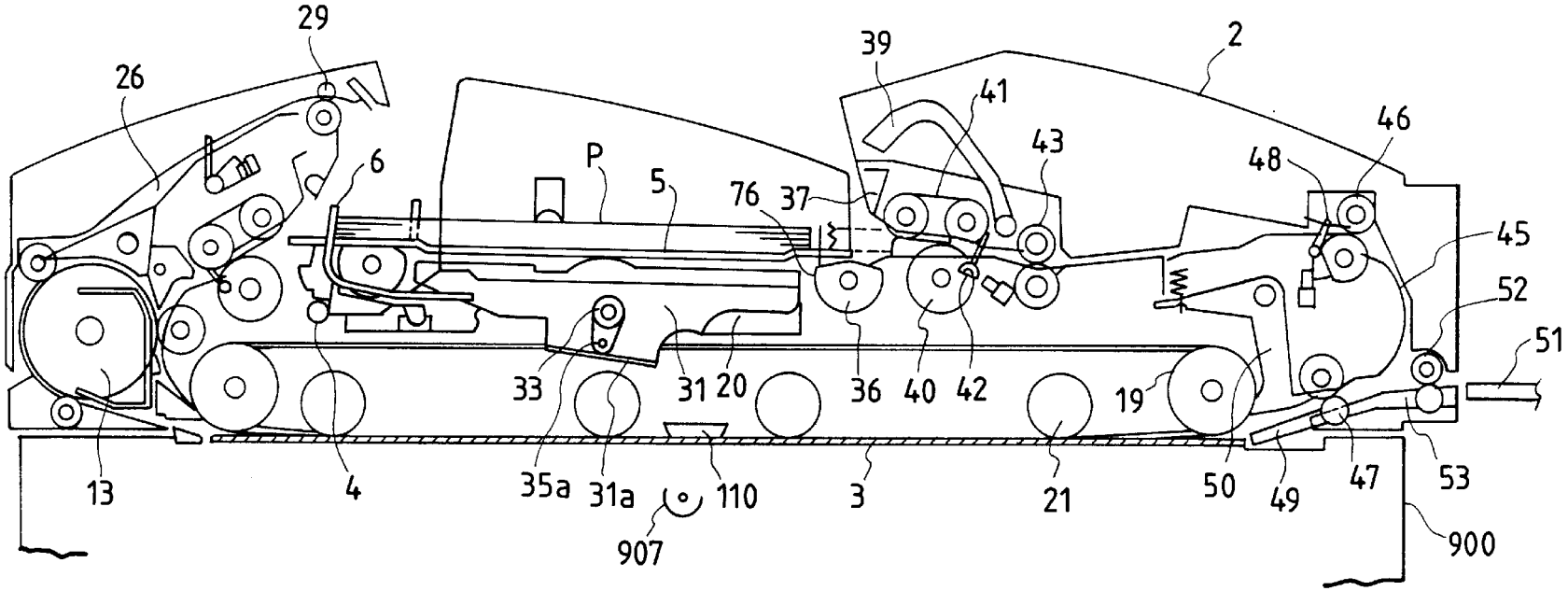
FIG. 3 is a view for explaining an operation of the automatic original feeding apparatus of FIG. 1.

The original stacking plate 5 can be rocked around a support shaft 4 between an inclined position shown in FIG. 1 and a horizontal position shown in FIG. 3 under the action which will be described later. In the inclined position shown in FIG. 1, the original P is conveyed to the platen glass 3 through the first convey path 16 as mentioned above, and, in the horizontal position shown in FIG. 3, the original P is conveyed to the platen glass 3 through a second convey path 45 from the trail end of the original.

The second convey path 45, convey belt 20 and discharge path 26 constitute a closed-loop path TC for conveying the original to the reading position and for discharging the original in a closed-loop fashion. Further, the switch-back path TS, convey belt 20 and closed-loop path TC constitute an original convey means for conveying the original P to the reading position and for discharging the original. The reference numeral 77 denotes a supply portion for supplying the original P fed out by a semi-circular feed-out roller 36 to the closed-loop path TC; 37 denotes a guide plate; 39 denotes a weight for urging the original P against the feed-out roller 36; 40 denotes a convey roller rotated in the original supplying direction; and 41 denotes a separation belt rotated in the original returning direction.

At a downstream side of a closed-loop path side separation portion comprised of the convey roller 40 and the separation belt 41, there is disposed the second convey path 45 for conveying the separated original P to the platen glass (reading position) 3. The second convey path 45 includes a pair of convey rollers 43, a regist sensor 48, a pair of regist rollers 46 and a pair of supply rollers 47. Between an upper roller of the pair of supply rollers 47 and the driven roller 19 associated with the convey belt 20, there is disposed a shiftable guide member 50 for introducing the original P to the platen glass 3 or for guiding the original P on the platen glass 3. The reference numeral 51 denotes a manual insertion tray for manually supplying an original P to the automatic original supplying apparatus 2; 52 denotes a manual insertion supply roller; and 53, 49 denote manual insertion guide plates.

Next, operations of the shutter 6 and the original stacking plate 5 in the original supplying operation will be explained.

Figure 6:
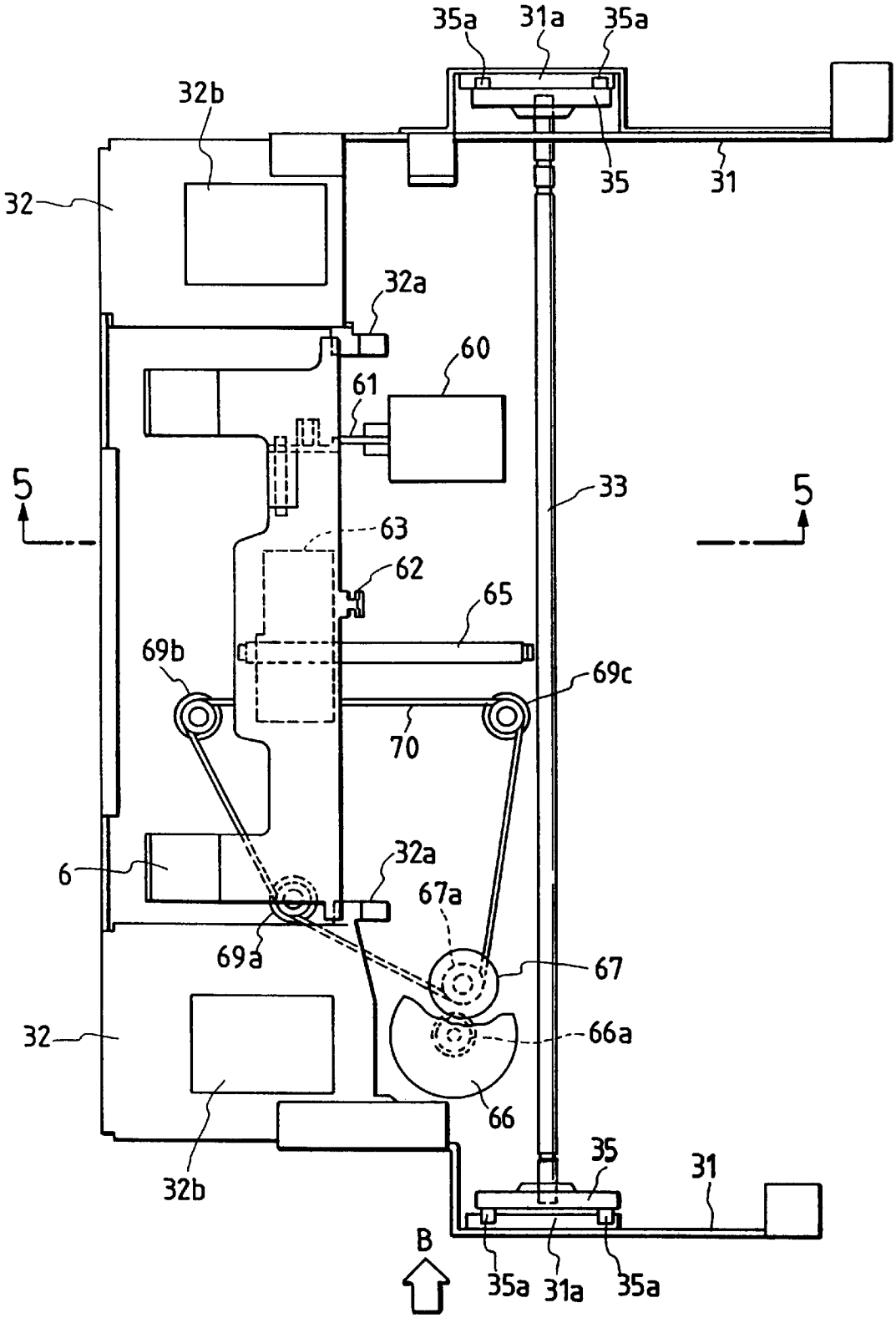
FIG. 6 is a plan view of a shutter provided on the original stacking plate of the automatic original feeding apparatus of FIG. 1.

In FIGS. 4A to 6, frames 31 and support members 32 integral therewith are disposed on both sides of the original stacking plate 5, and the support members 32 can be rocked around the support shaft 4. Bent portions 31*a* formed on the frames 31 can be lowered by drive pins 35*a* of drive members (lift/lower members) 35. The drive members 35 are secured to both ends of a connection shaft 33 which can be rotated by a drive source such as a motor. The drive members 35 and the drive source constitute a lift/lower drive device for lifting and lowering the original stacking plate 5. In FIG. 6, the reference numeral 32*b* denote openings through which the feed-out rollers 9 can be protruded upwardly.

When the original P is supplied from the trail end thereof (i.e., when the flow-reading is effected to achieve the high speed reading), by rotating the drive members 35, the bent portions 31*a* of the frames 31 are urged by the drive pins 35*a*. As a result, the original stacking plate 5 is rocked from an inclined condition (FIG. 4A) to a horizontal condition (FIG. 4C).

Figure 4A:
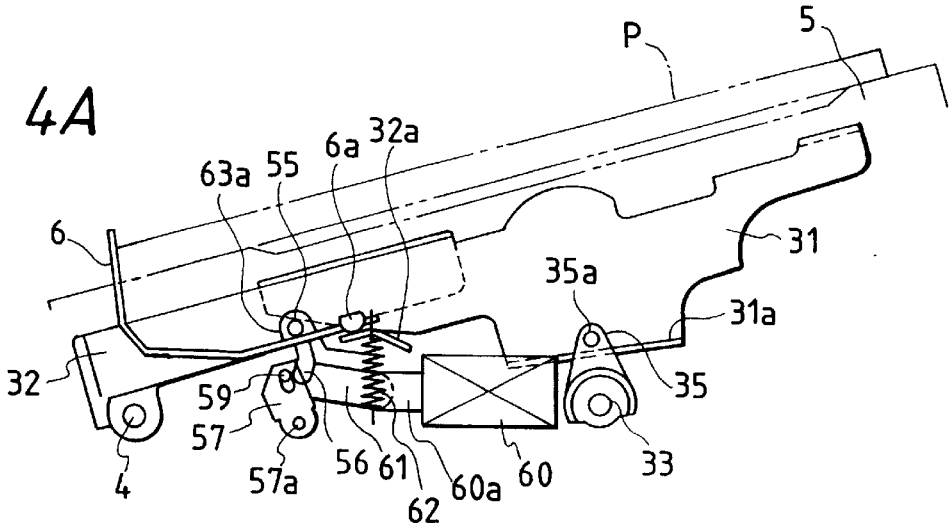
FIGS. 4A to 4C are views for explaining an operation of an original stacking plate of the automatic original feeding apparatus of FIG. 1.
Figure 4B:
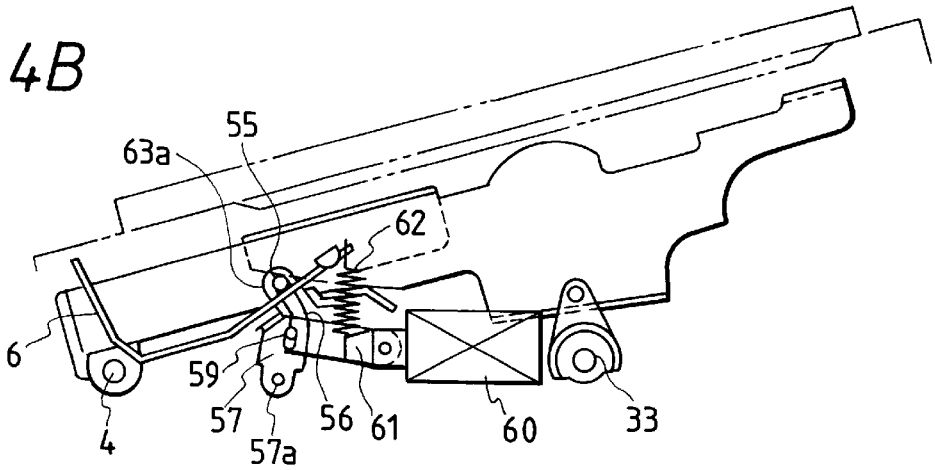
Figure 4C:
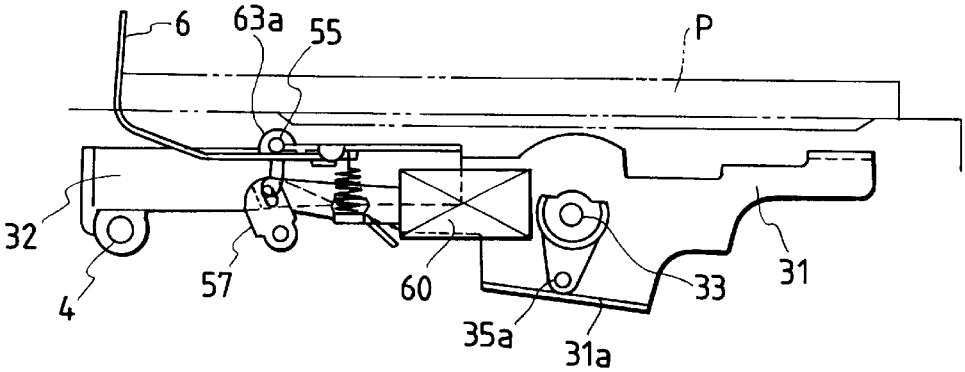
Figure 5A:
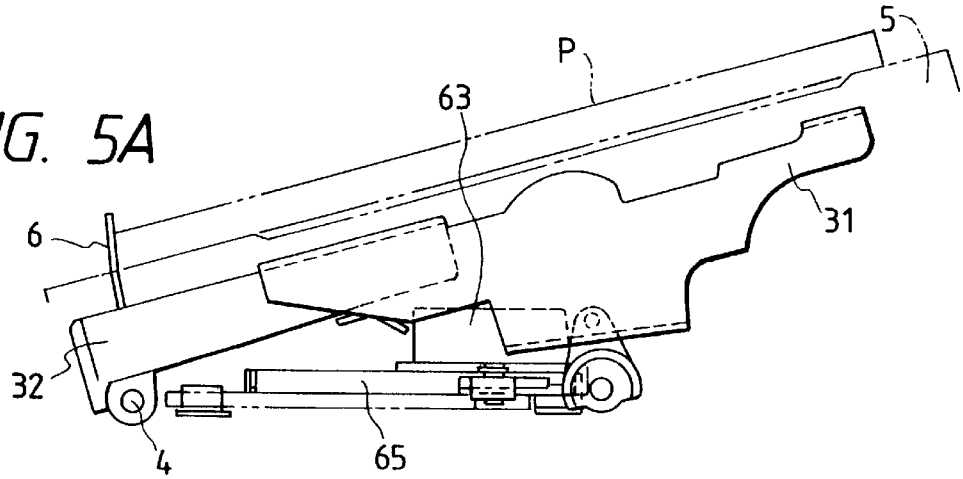
FIGS. 5A to 5C are views for explaining an operation of an original stacking plate of the automatic original feeding apparatus of FIG. 1.
Figure 5B:
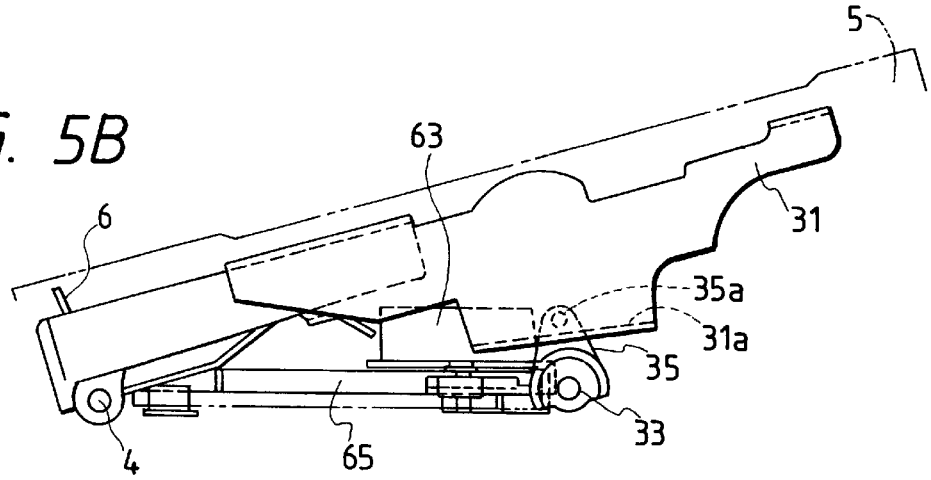
Figure 5C:
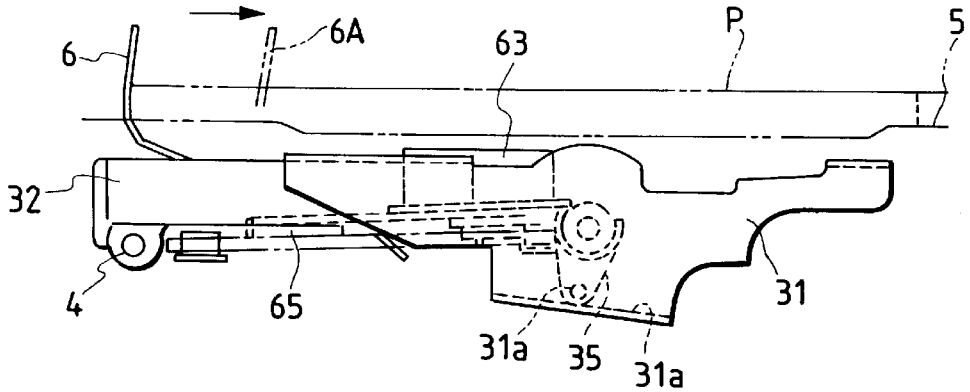

In FIGS. 4A to 4C, a support shaft 55 formed integrally with the shutter 6 is rotatably mounted on a support portion 63*a* integral with a block 63 (FIG. 6). A solenoid 60 for driving the shutter 6 has an operating member 60*a* pivotally connected to one end of a connection member 61, and a pin 59 is secured to the other end of the connection member. The pin 59 is engaged by an elongated slot formed in a free end portion of an arm 57 which can be rotated around a support pin 57*a*.

Further, a lower end of a driven member 56 having a free end secured to the support shaft 55 is opposed to the pin 59. The shutter 6 is biased in a clockwise direction in FIGS. 4A to 4C (i.e., toward a direction that the shutter 6 is protruded from the original stacking plate 5) by means of a tension spring 62 connecting between the shutter 6 and the connection member 61.

When the original P on the original stacking plate 5 is conveyed through the first convey path 16 (i.e., when the stationary reading is effected to obtain a plurality of copies), the shutter acts as a normal shutter, and, as shown in FIG. 4A, the shutter 4 is protruded from the original stacking plate 5 by a small amount. When a sheet supply start signal from the control device 930 (FIG. 2) is sent to the solenoid 60 to activate the latter, the arm 57 is rotated in a clockwise direction in FIG. 4A. As a result, the driven member 56 is pushed by the pin 59 to be rotated in an anti-clockwise direction as shown in FIG. 4B. At the same time, the shutter 6 integral with the driven member 56 is also rotated in the anti-clockwise direction. Consequently, the shutter 6 is retarded from an upper surface of the original stacking plate 5 (FIG. 4B). In this condition, by rotating the feed-out rollers 9, several originals P are sent to the separation portions 11, 12.

In FIGS. 5A to 5C and 6, the block 63 supporting the shutter 6 is shiftably supported by a guide shaft 65. The reference numeral 32*a* denotes guide pieces adapted to be engaged by projections 6*a* formed on both ends of the shutter 6 to guide the projections when the shutter 6 is returned to its initial position. In the condition shown in FIG. 4A, the projections 6*a* are urged against the guide pieces 32*a* under the action of the tension spring 62.

A pulse motor 66 for shifting the shutter 6 along the upper surface of the original stacking plate 5 has an output shaft to which an output gear 66*a* is secured. The output gear is meshed with a pulley gear 67. A belt 70 is wound around a pulley 67*a* of the pulley gear 67 and a plurality of pulleys 69*a*, 69*b*, 69*c*, and a portion of the belt is connected to the block 63. With this arrangement, when the motor 66 is rotated in accordance with the length of the original P, the shutter 6 is shifted along a longitudinal direction (front and rear direction) of the original stacking plate 5.

When the original P is conveyed toward the second convey path 45 from the trail end thereof, in the condition that the shutter 6 is maintained in the position shown in FIG. 4A, the original stacking plate 5 is lowered to the horizontal position (FIG. 4C) as mentioned above. Consequently, the guide pieces 32*a* of the support members 32 integral with the original stacking plate 5 are rotated to be lowered, with the result that the projections 6*a* contacted with the guide pieces are also rotated in the same direction (clockwise direction in FIGS. 4A to 4C). As a result, the shutter 6 is rotated in the clockwise direction relative to the original stacking plate 5. Thus, the protruded amount of the shutter becomes greater, as shown in FIG. 4C. In this condition, the shutter 6 is driven by the motor 66 to shift toward the second feed-out roller 36, with the result that the originals P are bundle-conveyed so that the originals can be supplied to the second convey path 45 by means of the second feed-out roller 36 and the second separation portion 40, 41.

In this way, when the shutter 6 is used as a bundle convey means, by increasing the protruded amount of the shutter 6, even if the ends (tip ends) of the originals P stacked on the original stacking plate 5 are curled, the ends of the originals can surely be caught by the shutter 6, thereby stabilizing the bundle-convey of the original bundle P.

The original P supplied by the second feed-out roller 36 and separated one by one by separation portion 40, 41 is conveyed to the platen glass (reading position) 3 through the second convey path 45. While the original P is being conveyed by the convey belt 20, the flow-reading is effected by the light source 907 stopped at a predetermined position shown by the broken line. Thereafter, the original is discharged onto the original stacking plate 5 through the discharge path 26.

In FIG. 1, when the flow-reading is effected, the light source (reading means) 907 is shifted to the predetermined position shown by the broken line. Above the light source 907 at this position, both lateral edges of the convey belt 20 is urged against the platen glass 3 by a pair of urging members 110. As a result, even if undulations are generated in the lateral edge portions of the convey belt 20 for a long term use, both lateral edges of the original can be prevented from floating, thereby preventing the poor reading.

Figure 7A:
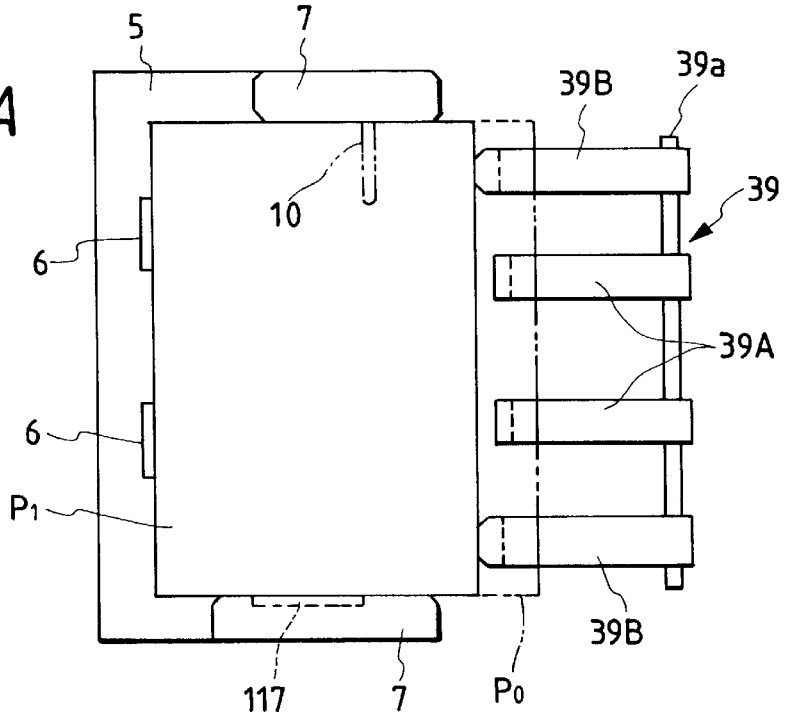
FIGS. 7A and 7B are views showing a condition that an original stack before reading is separated from an original stack after reading.
Figure 7B:
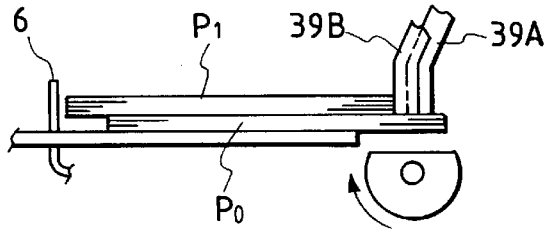

FIGS. 7A and 7B show the shutter 6 and the weight 39 for urging and partitioning the originals bundle-conveyed by the shutter. In FIG. 7A, the originals P rested on the original stacking plate 5 are regulated by manually shifting the pair of width regulating plates 7. The originals P are aligned with each other in the width-wise direction by reciprocally shifting a jog member 117 provided on one of the width regulating plates 7 in the width-wise direction (Y direction). The weight 39 has a base pivotally mounted on a support shaft and comprises a lift/lower urging member 39A for urging the non-supplied original bundle $P_0$ on the original stacking plate 5 against the feed-out roller 36, and a partition member 39B for regulating the tip ends of the originals $P_1$ (once supplied from the original stacking plate and) discharged onto the original bundle $P_0$ as shown in FIG. 7B.

Figure 8:
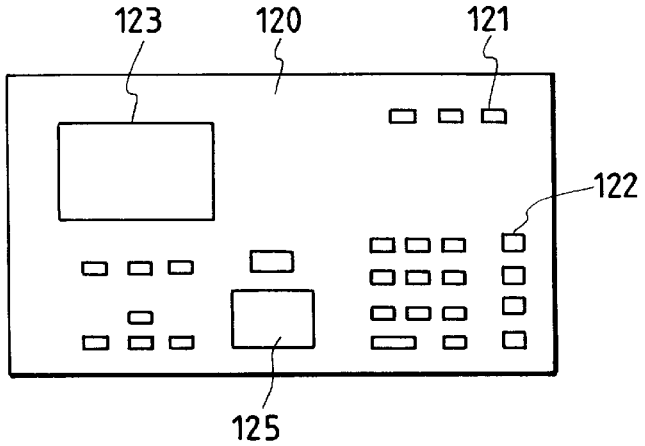
FIG. 8 is a plan view of an operation panel of the image forming apparatus of FIG. 2.

FIG. 8 shows an operation panel 120 associated with the copying machine 900 and the automatic original supplying apparatus 2. The operation panel includes a start button 125, a stop key 121 for stopping the supplying of original P, and a flow-reading adjust key 122.

Figure 9:
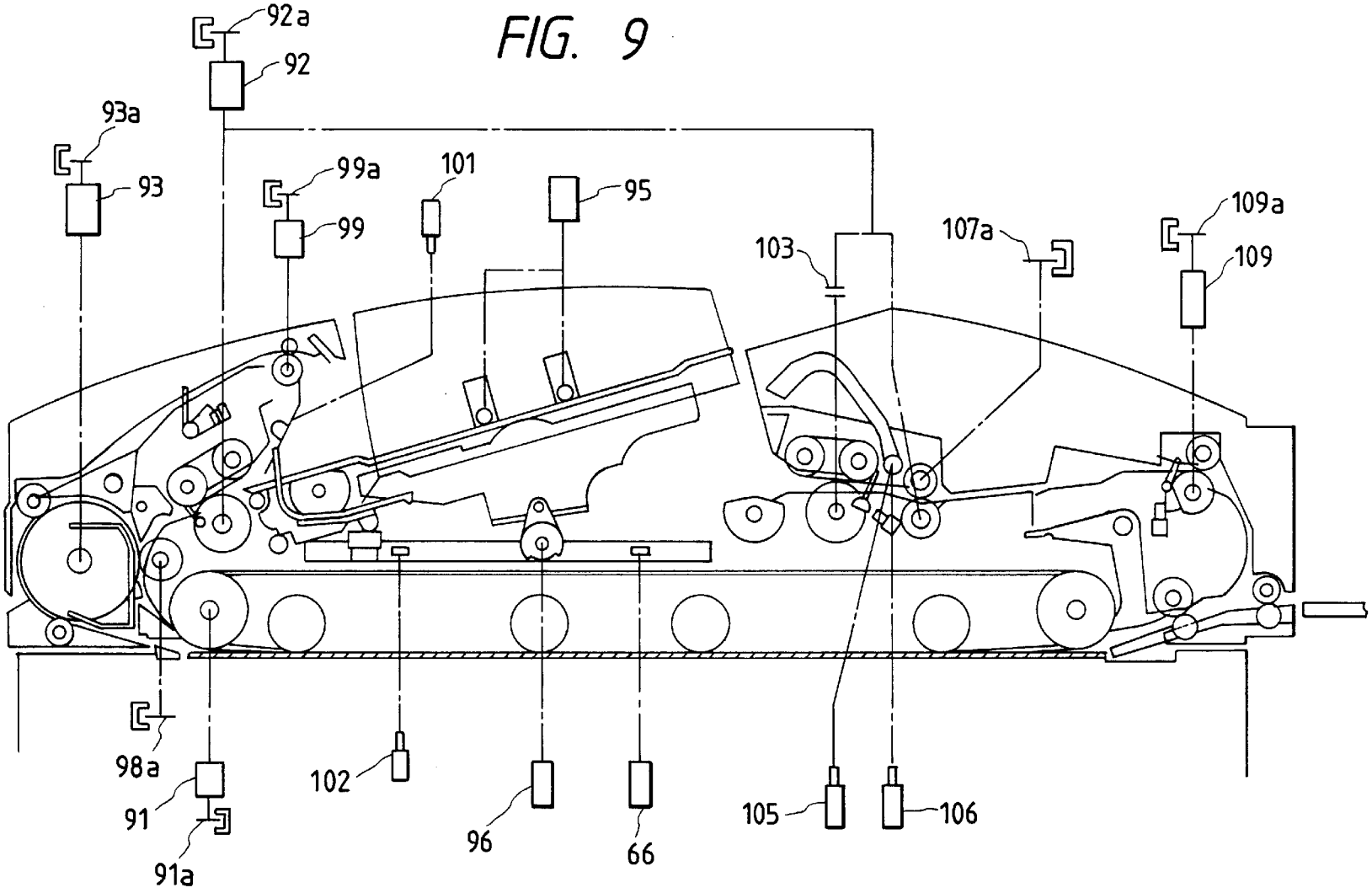
FIG. 9 is a view for explaining a drive system of the automatic original feeding apparatus of FIG. 1.

FIG. 9 shows a drive system of the automatic original supplying apparatus. In FIG. 9, the reference numeral 95 denotes a recycle motor for driving the recycle lever 10 partitioning the discharged originals $P_1$ from the non-supplied originals $P_0$; 101 denotes a weight solenoid (SOL) for lifting and lowering the urging member 8; 92 denotes a separation motor; 92*a* denotes an encoder of the separation motor; 103 denotes a clutch for transmitting rotation of the separation motor 92 to the separation portion 40, 41; 91 denotes a belt motor for driving the convey belt 20; 91*a* denotes an encoder of the belt motor; 93 denotes a reverse rotation motor for driving the reverse rotation roller 13; 93*a* denotes an encoder of the reverse rotation motor; 98*b* denotes a driven roller encoder for the pair of regist rollers 13, 15; 99 denotes a discharge motor for driving the pair of discharge rollers 29; 99*a* denotes an encoder of the discharge motor; 66 denotes a bundle convey motor for shifting the shutter 6; 102 denotes a tray lift/lower motor for lifting and lowering the original stacking plate 5; 105 denotes a partition member solenoid (SOL) for lifting and lowering the partition member 39B; 106 denotes a weight solenoid (SOL) for lifting and lowering the urging member 39A; 107*a* denotes an encoder for the pair of convey rollers; 109 denotes a CP regist motor for driving the pair of regist rollers 46; and 109*a* denotes an encoder of the CP regist motor.

Figure 10:
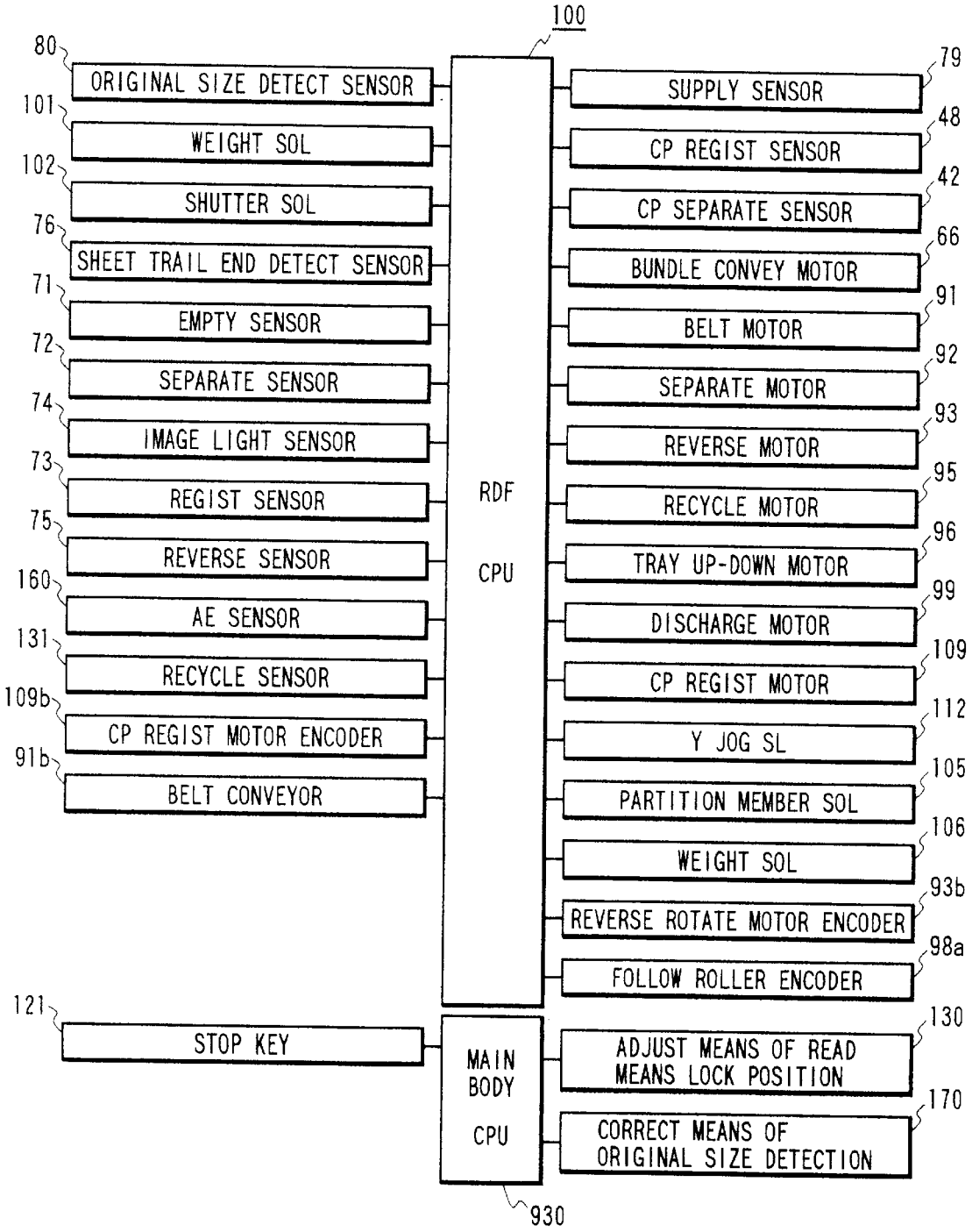
FIG. 10 is a block diagram of the image forming apparatus of FIG. 2.

FIG. 10 is a block diagram for controlling the automatic original supplying apparatus 2. Various sensor disposed at various positions of the automatic original supplying apparatus 2 of FIG. 1 are connected to the control device (CPU) 100 of the automatic original supplying apparatus 2. In FIG. 1, the reference numeral 71 denotes an empty sensor for detecting presence/absence of the original P on the original stacking plate 5; 72 denotes the separation sensor; 73 denotes a pre-regist sensor; 74 denotes a post-regist sensor; 75 denotes a reverse rotation sensor for detecting the original P passing through the reverse rotation roller 13; 42 denotes a CP side separation sensor; 48 denotes a regist sensor; and 79 denotes a discharge sensor.

Figure 11:
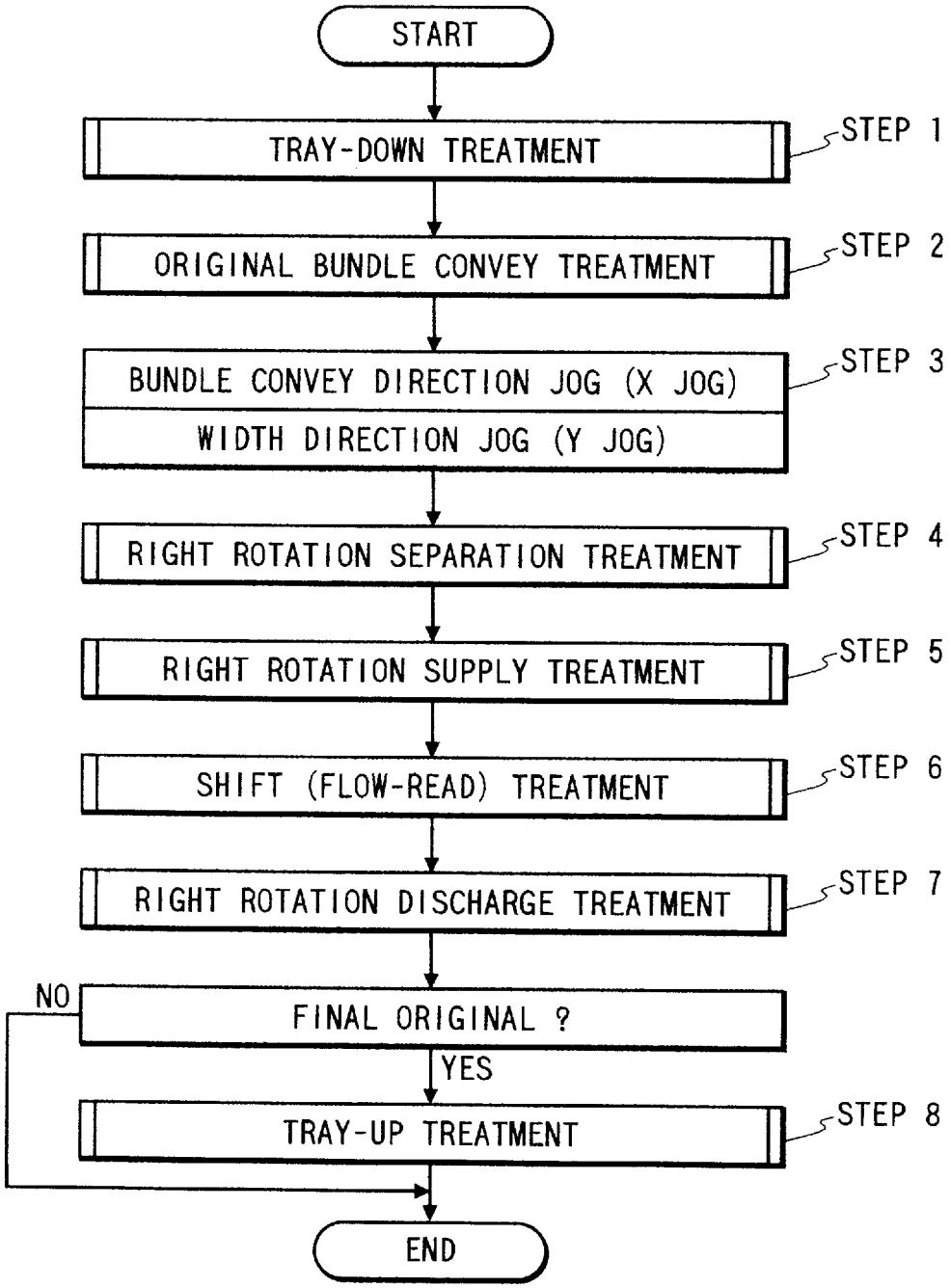
FIG. 11 is a flow chart in a flow-reading mode of the automatic original feeding apparatus of FIG. 1.

Next, the flow-reading mode in which the original is read in the flow-reading fashion will be explained with reference to FIG. 11. A tray-down treatment is effected to shift the original stacking plate 5 to the lowermost position (step 1), and then, the original bundle-convey treatment is effected to shift the original bundle P to the right (step 2). Thereafter, the bundle-convey direction jog (X jog) is effected for the original bundle P, and then, the width direction jogs (Y jogs) are effected successively (step 3). Then, the right rotation separation treatment is effected to separate only the lowermost original from the other originals (step 4).

Thereafter, the right rotation supply treatment is effected to locate the original at a position upstream of an image tip end of the flow-reading by a distance of l (step 5). When original change (flow-reading start) trigger from the copying machine 900 is received, the shift (flow-reading) treatment is effected (step 6) so that the image is read while the optical system 908 of the copying machine 900 is being fixed at a predetermined position, and the original is shifted to the fixed image tip end at a predetermined speed. Then, the right rotation discharge treatment (step 7) is effected to discharge the original onto the original stacking plate 5.

Further, during the right rotation separation treatment (step 4) which will be described later, if it is judged that the original is not a final original, by effecting the right rotation separation treatment during the next right rotation supply treatment (step 5), the continuous original supply can be realized. On the other hand, after the right rotation discharge treatment (step 7), if it is judged that the original is a final original, the tray-up treatment is effected to return the original stacking plate 5 to its initial position (step 8). After the flow-reading treatment, when plural image forming operations are desired, in the copying machine 900, the light source 907 is returned to its home position, and then, the flow-reading may be repeated by desired cycles while shifting the light source 907.

Figure 12:
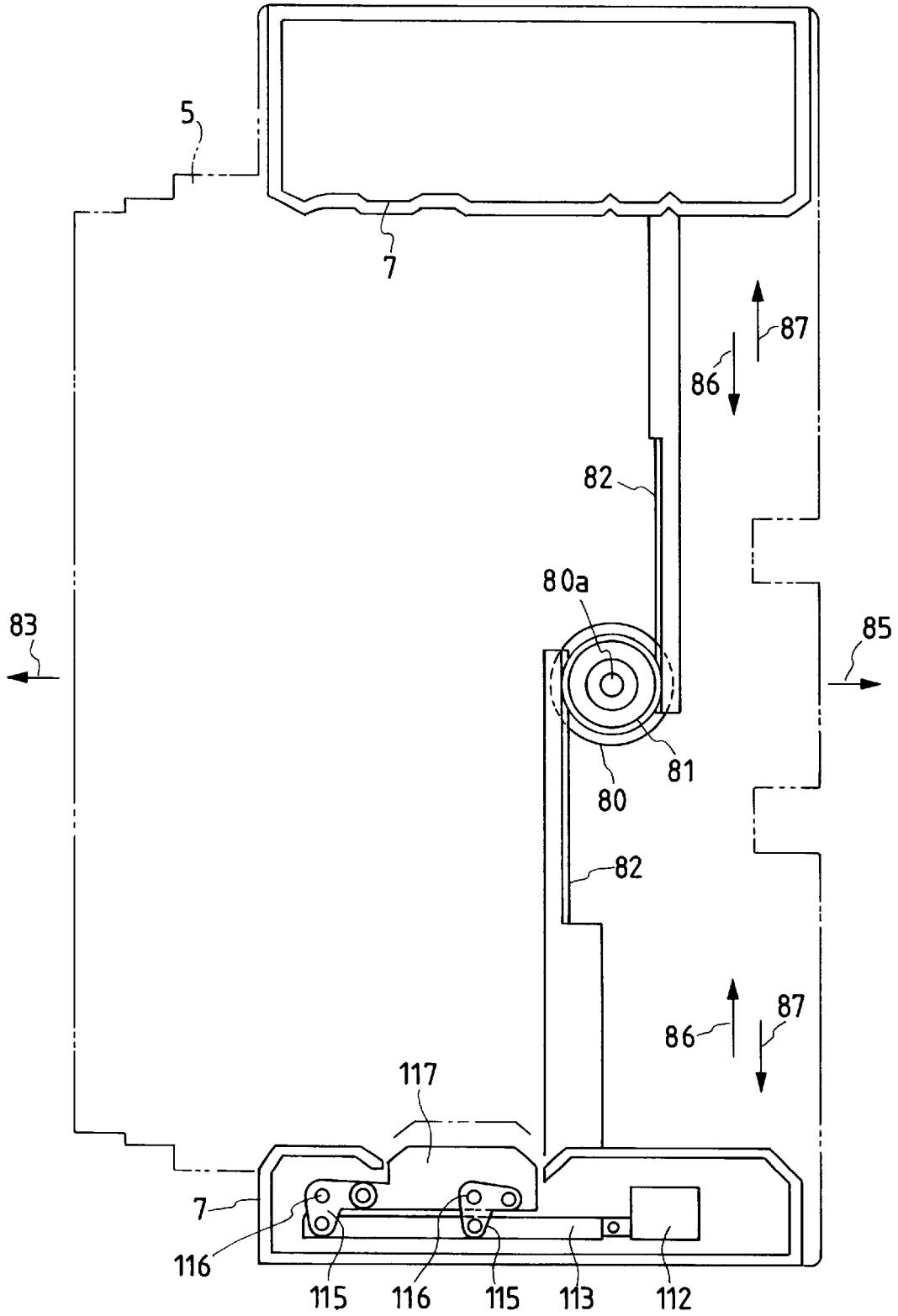
FIG. 12 is a plan view showing width regulating plates provided on the original stacking plate of the automatic original feeding apparatus of FIG. 1 and a drive portion therefor.

Next, a drive mechanism for the width regulating plates 7 will be explained with reference to FIG. 12. The pair of width regulating plates 7 are mounted on both sides of the original stacking plate 5 for shifting movement in the width-wise directions (shown by the arrows 86 and 87). An original size detection sensor (original size recognition means) 80 comprised of a rotary volume is provided at a central portion of the original stacking plate 5, and a pinion 81 is secured to an output shaft 80*a* of the rotary volume 80.

A pair of racks 82 are meshed with the pinion 81 on opposite sides thereof, and base ends of the racks are secured to the respective width regulating plates 7. With this arrangement, when the width regulating plates 7 are manually shifted so that the width regulating plates are urged against the lateral edges of the original stack or bundle P, the rotary volume 80 is rotated in accordance with the width of the original, thereby automatically detecting the size of the original P.

Figure 13:
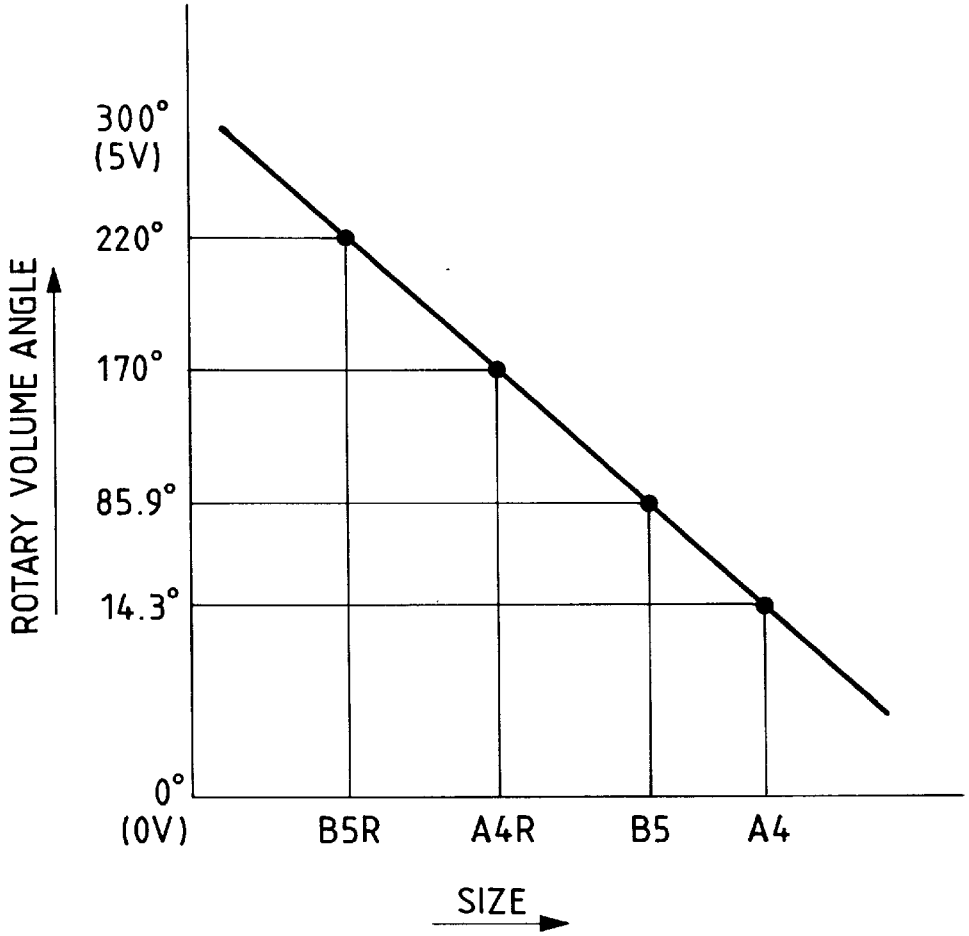
FIG. 13 is a graph showing a relation between an angle of a rotary volume for detecting positions of the width regulating plates of FIG. 12 and a size of sheets to be stacked.

FIG. 13 shows a relation between the size of the original P rested on the original stacking plate 5 and an rotation angle of the rotary volume 80, so that the size of the original P rested on the original stacking plate 5 can be detected on the basis of the rotation angle of the rotary volume 80.

A side jog (Y jog) solenoid (SOL) 112 is provided on one of the width regulating plates 7 is connected to a connection lever 113 to which a pair of links 115 (rotatably supported by corresponding pins 116) are pivotally connected. With this arrangement, when the side jog solenoid 112 is turned ON/OFF, the jog member 111 is reciprocally moved in the width-wise direction of the original stacking plate 5, thereby aligning the originals P with each other in the width-wise direction.

Figure 14:
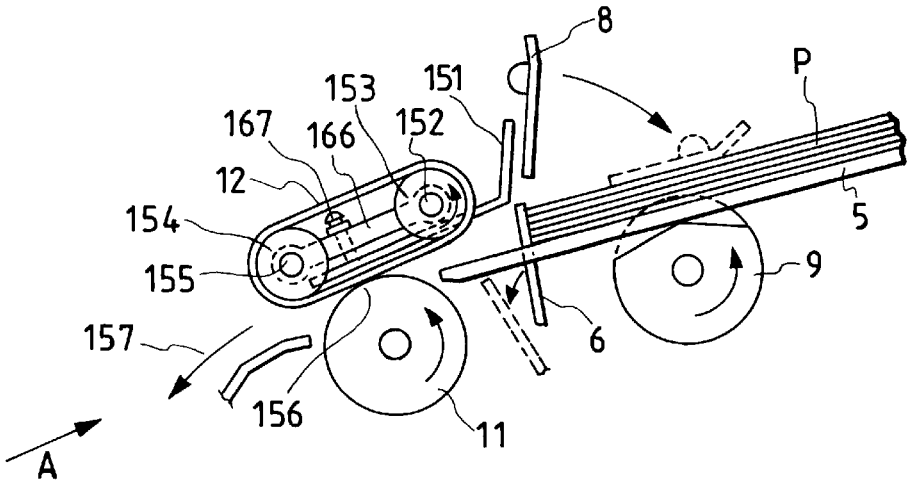
FIG. 14 is a sectional view of a sheet supplying apparatus according to a first embodiment of the present invention.
Figure 15A:
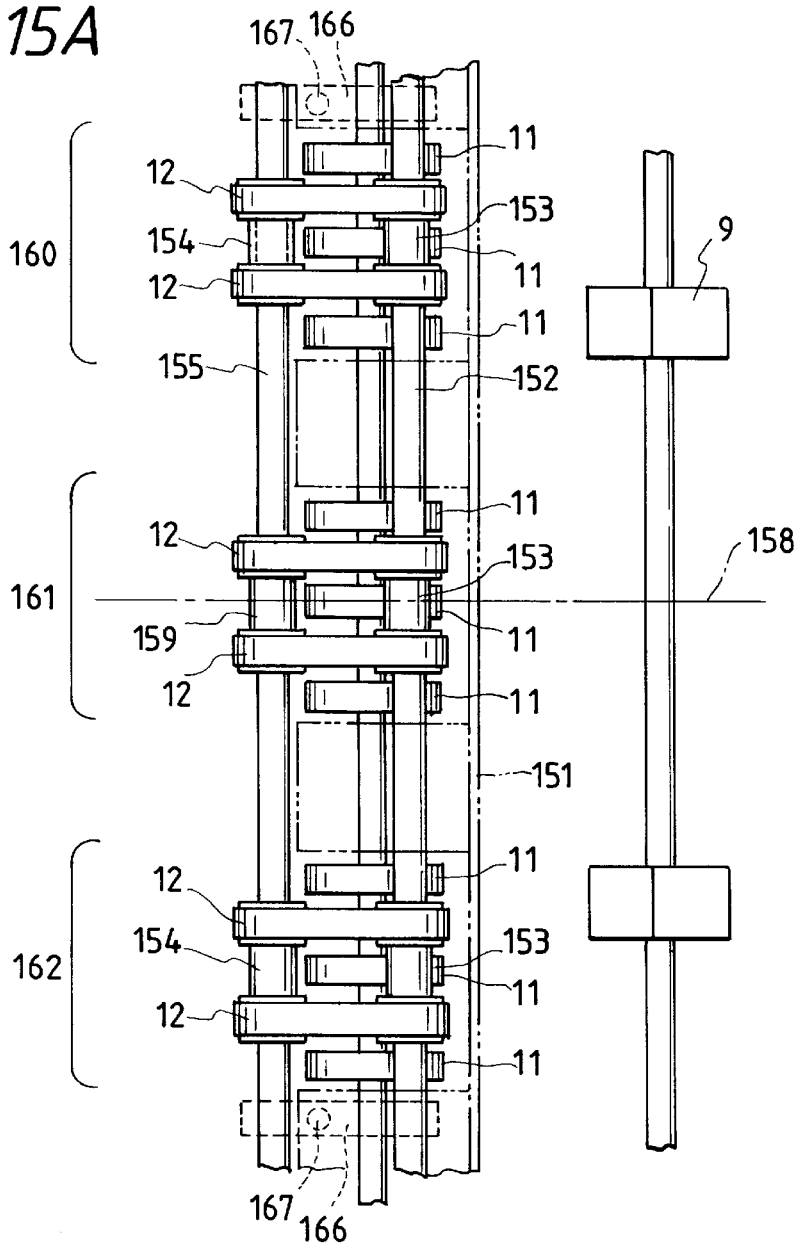
FIG. 15A is a plan view of the sheet supplying apparatus of FIG. 14.
Figure 15B:
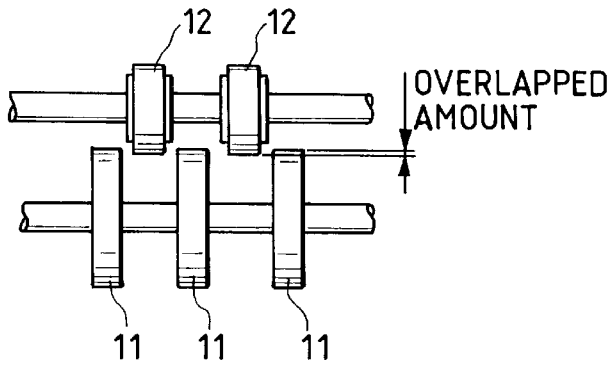
FIG. 15B is a view looked at from a direction shown by the arrow A in FIG. 14.

Next, the separation portions for separating and supplying the originals stacked on the original stacking plate 5 one by one will be fully described with reference to FIGS. 14 and 15B. In the sectional view shown in FIG. 14, in order to send the originals on the original stacking plate 5 to separation nips 156, the shutter 6 is retarded from the original stacking plate 5 to the position shown by the broken line, the semi-circular rollers 9 are rotated in the direction shown by the arrow, and the weight 8 is urged against the original bundle. The sheet bundle P is fed out toward the separation nips 156 in a wedged fashion while being guided by the regulating plate 151.

The separation belts 12 are wound around separation drive pulleys 153 secured to a separation drive shaft 152 (to which a driving force is transmitted) and separation driven pulleys 154, 159 rotatable with respect to a separation driven shaft 155 so that, when the separation drive shaft is driven, the separation belts 12 are rotated in a direction shown by the arrow (sheet returning direction). Further, the separation belts are disposed alternately with the convey rollers 11 and are overlapped with the convey rollers at the separation nips 156 (FIG. 15B). The separation driven pulley 159 disposed on a center line (sheet convey reference position) 158 of the sheet has a diameter slightly greater than those of the other separation driven pulleys 154 so that, in the separation pairs 160, 161, 162, the overlap amount of the separation pair 161 on the center line 158 of the sheet becomes greater than the overlap amounts of the other separation pairs 160, 162.

Further, holding members 166 for determining a distance between the separation drive shaft 152 and the separation driven shaft 155 and for bearing these shafts permits the rocking movement of the separation driven shaft 155 around the separation drive shaft 152. The holding members 166 are provided with stopper members 167 which can adjust a distance between the stoppers and the regulating plate 151, and the overlap amount can be adjusted by changing the distance between the stoppers 167 and the regulating plate. Incidentally, the stopper members 167 may comprise screws so that the distance can be adjusted by rotating the screws.

The overlap amounts of the side separation pairs 160, 162 and the overlap amount of the center separation pair 161 have the above-mentioned optimum overlap amounts of 0.2 to 0.5 mm already described in connection with the prior art. For example, in a case where the diameter of the separation driven pulley 159 in the center separation pair is greater than those of the pulleys 154 in the side separation pairs by 0.4 mm, when the overlap amounts of the side separation pairs 160, 162 are adjusted to 0.3 mm, the overlap amount of the center separation pair 161 becomes 0.5 mm (=0.3+0.4/2). Any combination can be adopted so long as the overlap amount of the center separation pair 161 is slightly greater than those of the side separation pairs 160, 162 and is included within the optimum range of 0.2 to 0.5 mm.

Figure 16:
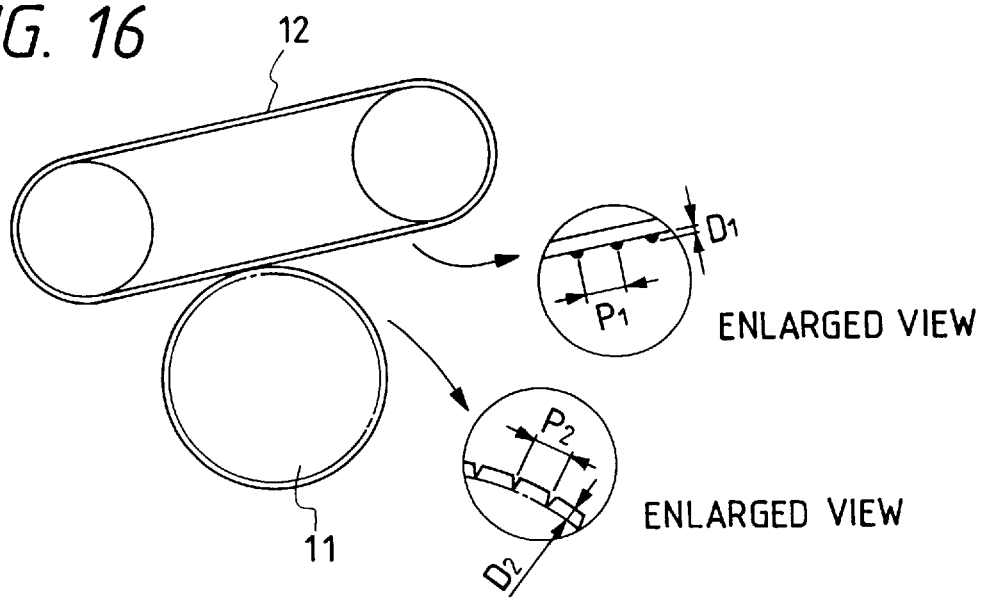
FIG. 16 is a view for explaining surfaces of a belt and a roller used in the sheet supplying apparatus of FIG. 14.

As shown in FIG. 16, grooves having a predetermined depth D are formed in outer peripheral surfaces of the separation belt 12 and the convey rollers 11 at a predetermined pitch P so that paper powder from the originals and/or silicone oil adhered to the originals can be caught by the grooves, thereby generating stable coefficient ($\mu$) of friction in various originals. Further, the separation belt 12 can suppress resistance caused due to absorption between the original and the separation belt, thereby maintaining the proper coefficient ($\mu$) of friction between the belt and the original.

When the original bundle reaches the separation nips 156 in the wedged fashion, the originals other than the lowermost original are blocked by the action of the separation belts 12, and only the lowermost original is separated and supplied in the direction shown by the arrow 157.

Incidentally, since the sheet supplying forces of the separation pairs 160, 161, 162 in the direction 157 are proportional to the overlap amounts, the supplying force of the center separation pair 161 is greater than the supplying forces of the side separation pairs 160, 162. The reason is that, since the coefficient of friction of the outer peripheral surface of the convey roller 11 is set to be greater than that of the separation belt 12, when the overlap amount is increased, the increase in the sheet feeding force of the convey roller 12 becomes greater than the increase in the sheet returning force of the separation belt 12 and thus the sheet supplying force is also increased accordingly.

Further, the sheet returning force of the separation belt 12 in the center separation pair 161 is greater than those in the side separation pairs.

Figure 23:
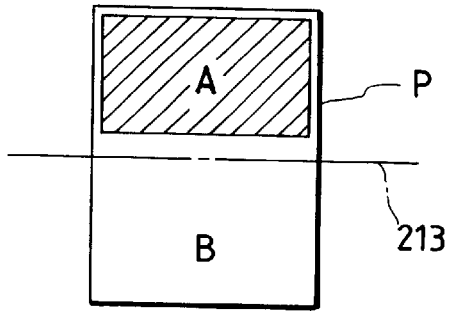
FIG. 23 is a view showing an example of an original.

For example, as described in connection with the prior art (FIG. 23), in the case where the original (sheet) is outputted from an image forming apparatus such as a color copying machine, a color printer or the like, and the sheet includes a thick image portion (such as a dense image) copied on an upper area A above the center line of the sheet and a thin image portion (such as characters) copied on a lower area B, since the area A having the thick image is covered by toner substantially entirely and is coatedby the fixing silicone oil, the coefficient of friction of the area is extremely low; whereas, in the area B having the larger surface of the sheet itself, since the fixing silicone oil is absorbed to the texture of the sheet, the coefficient of friction of the area B becomes considerably greater than that of the area A. Even when such a sheet is used, in the separation nips 156, since the sheet supplying force and the sheet returning force acting on the sheet in the side separation pairs 160, 162 are both small, the difference between the sheet supplying force and the sheet returning force of the side separation pair 160 gripping the area A and the sheet supplying force and the sheet returning force of the side separation pair 162 gripping the area B becomes smaller, with the result that skew moment acting on the sheet also becomes smaller, thereby preventing the skew-feed of sheet.

Further, in the sheet bundle including a plurality of sheets, even when the sheet supplying forces of the side separation pairs 160, 162 are small, since the sheet supplying forces of the center separation pairs 161 is great, the total sheet supplying force is substantially the same as that in the conventional cases, thereby achieving the stable sheet separation and sheet supply. Incidentally, the sheet supplying forces of the separation pairs 160, 161, 162 may be selected so that the total sheet supplying forces of these pairs becomes the same as that in the conventional case.

(Second Embodiment)

Figure 17:
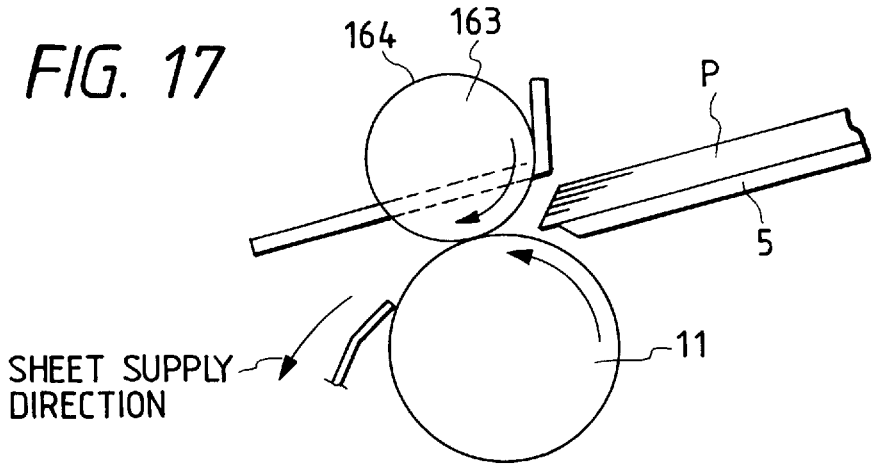
FIG. 17 is a sectional view of a sheet supplying apparatus according to a second embodiment of the present invention.

As shown in FIG. 17, even when the return member rotated in the sheet returning direction to block the sheets other than the lowermost sheet (on the tray 5) is constituted by return rollers 163, 164, a diameter of the return roller 164 in the center separation pair is selected to be slightly greater than those of the return rollers 163 in the side separation pairs so that the overlap amount of the center separation pair becomes greater than those of the side separation pairs. Thus, since the sheet supplying forces and the sheet returning forces of the side separation pairs are small, the skew moment acting on the sheet can be minimized, thereby preventing the skew-feed of sheet and achieving the stable sheet separation and sheet supply.

(Third Embodiment)

Figure 18:
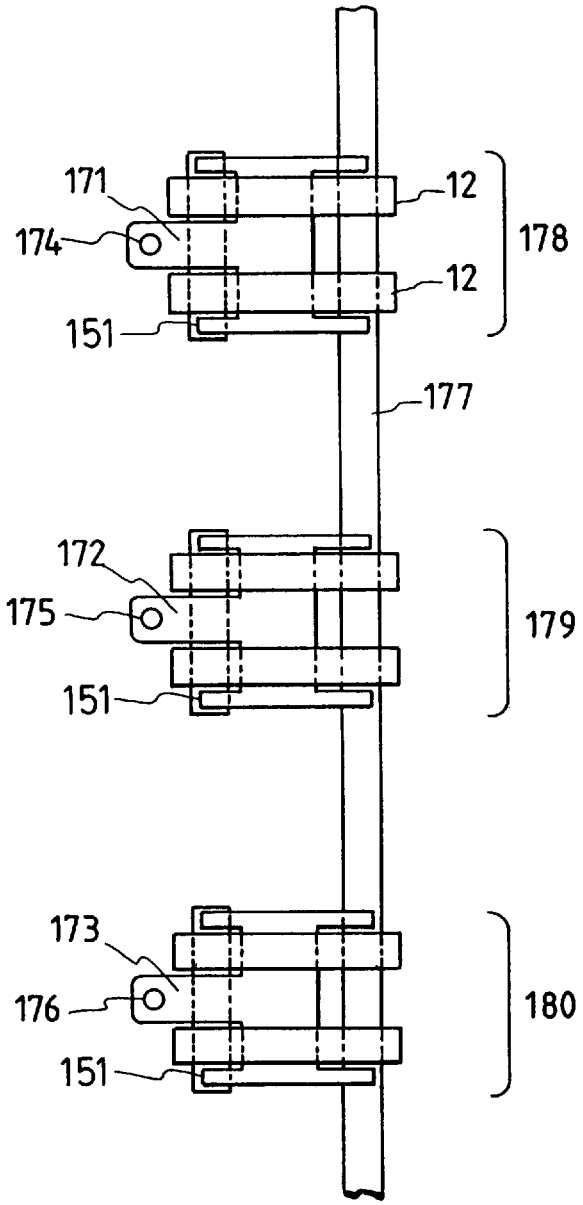
FIG. 18 is a plan view of a sheet supplying apparatus according to a third embodiment of the present invention.
Figure 19:
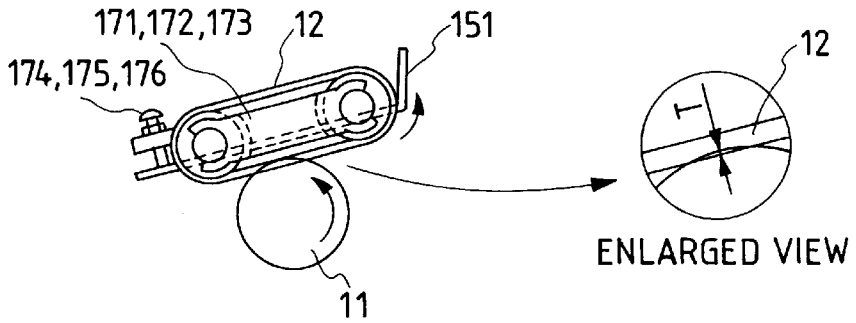
FIG. 19 is a sectional view of a sheet supplying apparatus according to the third embodiment of the present invention.

As shown in FIGS. 18 and 19, the separation belts 12 are wound around separation drive pulleys secured to a separation drive shaft 177 (to which a driving force is transmitted) and separation driven pulleys 176 driven by rotations of the separation belts. Further, three separation pairs 178, 179, 180 are independently provided with separation holders 171, 172, 173 each for determining a distance between the separation drive shaft and the driven shaft and for bearing these shafts. The overlap amounts T of the separation pairs can be independently adjusted by adjust screws 174, 175, 176 contacted with the regulating plate 151. Since the overlap amounts of the side separation pairs 178, 180 are set to be smaller than the overlap amount of the center separation pair 179, the same technical advantage can be obtained.

(Fourth Embodiment)

The pitch $P_2$ of the grooves (FIG. 16) formed in the outer peripheral surface of the convey roller 11 in the center separation pair 179 may be longer than the pitches of the grooves formed in the outer peripheral surfaces of the convey rollers 11 in the side separation pairs 178, 180. In this case, since the contact area between the center convey roller 11 and the sheet becomes greater than the contact area between the side convey roller 11 and the sheet, the same technical advantage can be expected. Incidentally, not only the pitch is changed, but also the shape of the grooves, width of roller and/or material of roller may be changed so that the sheet supplying force of the center separation pair becomes greater than those of the side separation pairs.

(Fifth Embodiment)

Figure 20:
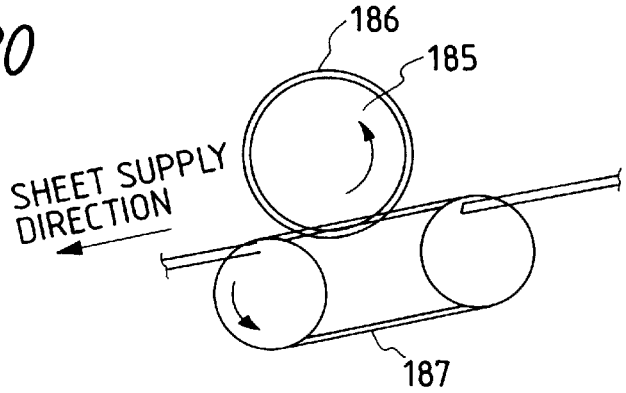
FIG. 20 is a sectional view of a sheet supplying apparatus according to a fifth embodiment of the present invention.
Figure 21:
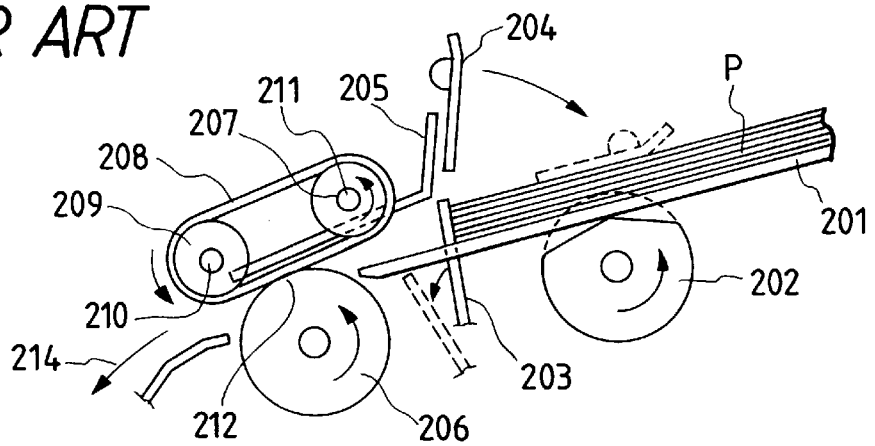
FIG. 21 PRIOR ART
FIG. 21 is a sectional view showing an example of a conventional sheet supplying apparatus.
Figure 22:
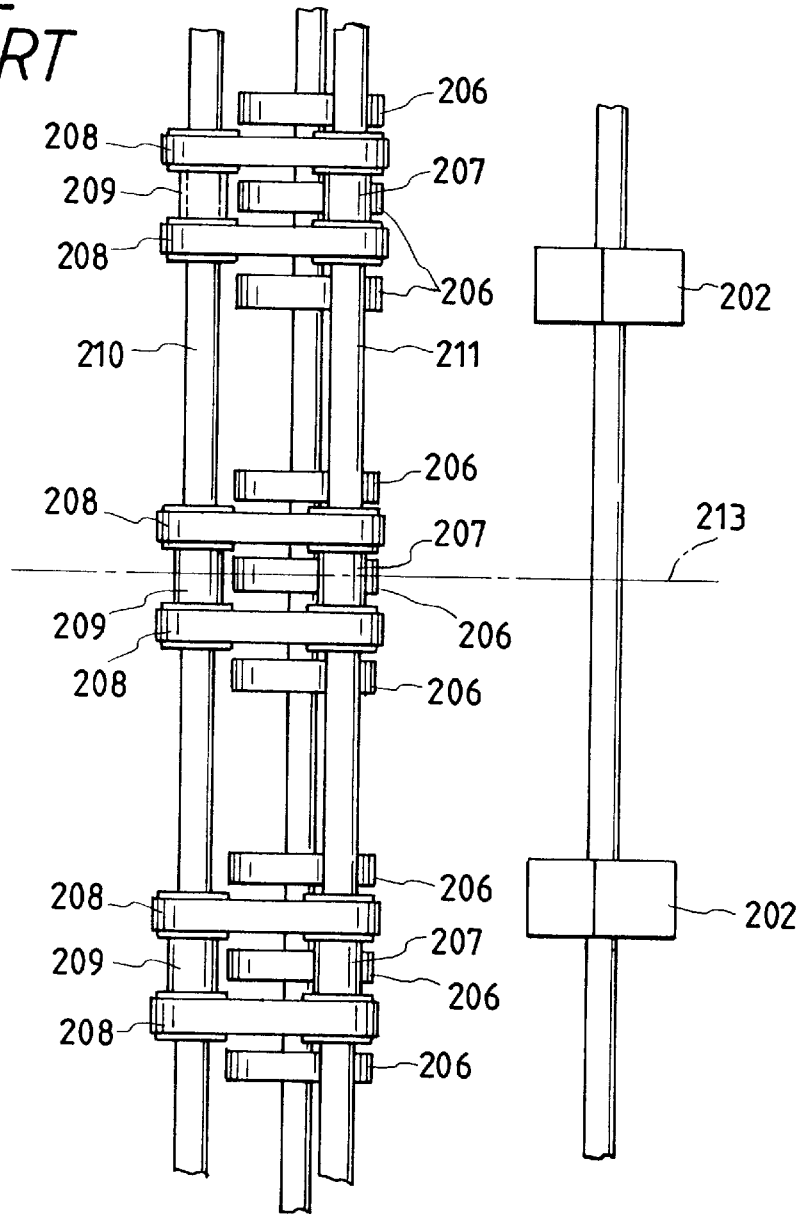
FIG. 22 PRIOR ART
FIG. 22 is a plan view of the sheet supplying apparatus of FIG. 21.

FIG. 20 shows separation portions comprising sheet supply belts 187 rotated in the sheet supplying direction and separation rollers 185, 186 rotated in the sheet returning direction. As is in the aforementioned embodiments, diameters of the separation rollers 185 in the side separation pairs are slightly smaller than a diameter of the separation roller 186 in the center separation pair, and the overlap amounts of the side separation pairs are smaller than the overlap amount of the center separation pair. Thus, the same technical advantage can be achieved.

What is claimed is:

1. A sheet supplying apparatus having a sheet separation means for separating and feeding sheets one by one, said separation means comprising a plurality of separation portions provided in a perpendicular direction to the sheet supplying direction, wherein each separation portion includes (i) a plurality of rotary sheet supply means including a central, first and second portions, provided along the perpendicular direction and contact with a first surface of the sheet to feed the sheet in a sheet feeding direction and (ii) at least one rotary sheet return means disposed between adjacent said sheet supply means and contact with a second surface of the sheet to feed the sheet in a sheet returning direction, wherein one of said plurality of separation portions is disposed at a position corresponding to the central portion and other two of said plurality of separation portions are positioned at positions corresponding to the both ends of the sheet in the width-wise direction thereof;

wherein in each separation portion, a force to supply a sheet by said sheet supply means is set greater than a force to return a sheet by said sheet return means; and wherein a difference between a sheet supplying force and a sheet return force at a central separation portion is selected to be greater than a corresponding difference for the both ends separation portions.

2. A sheet supplying apparatus according to claim 1, wherein an overlap amount between said sheet supply means and said sheet return means in said central separation portion is selected greater than that in the other separation portions on both sides of said center separation portion.

3. A sheet supplying apparatus according to claim 2, wherein said sheet supply means is a convey roller and said sheet return means is a reverse rotation belt, and wherein said convey rollers and said reverse rotation belts are alternately disposed in the width-wise direction of the sheet, and the overlap amount between said convey roller and said reverse rotation belt in said central separation portion is selected greater than that in the other separation portions on both sides of said center separation portion.

4. A sheet supplying apparatus according to claim 3, wherein a diameter of a pulley holding said reverse rotation belt of said central separation portion is selected greater than that of pulleys holding said reverse rotation belts of the other separation portions, thereby increasing the overlap amount of said central separation portion.

5. A sheet supplying apparatus according to claim 2, wherein said sheet supply means is a convey roller and said sheet return means is a reverse rotation roller, and wherein said convey rollers and said reverse rotation rollers are alternately disposed in the width-wise direction of the sheet, and the overlap amount between said convey roller and said reverse rotation roller in said central separation portion is selected greater than that in the other separation portions on both sides of said center separation portion.

6. A sheet supplying apparatus according to claim 2, wherein said sheet supply means is a convey belt and said sheet return means is a reverse rotation roller, and wherein said convey belts and said reverse rotation rollers are alternately disposed in the widthwise direction of the sheet, and the overlap amount between said convey belt and said reverse rotation roller in said central separation portion is selected greater than that in the other separation portions on both sides of said center separation portion.

7. A sheet supplying apparatus according to claim 2, wherein the overlap amounts of said separation portions can be adjustable.

8. A sheet supplying apparatus according to claim 7, wherein the overlap amounts of said separation portions can be adjusted independently.

9. A sheet supplying apparatus according to claim 2, wherein the overlap amount of said central separation portion is greater than those of the other separation portions by 0.2 to 0.5 mm.

10. A sheet supplying apparatus according to claim 1, wherein knurling is formed on a surface of said sheet supply means, and a pitch of the knurling in said central separation portion is selected greater than that in the other separation portions, thereby increasing a supplying force of said central separation portion.

11. A sheet supplying apparatus according to claim 10, wherein said central separation portion is disposed on a convey reference position for the sheet.

12. A sheet supplying apparatus according to claim 1, wherein said separation means separates the sheets supported by a sheet supporting means and fed out by a pick-up means one by one.

13. A sheet supplying apparatus according to claim 12, further comprising urge means for urging said pick-up means against a lowermost sheet of the sheets supported by said sheet supporting means to feed out it.

14. An image reading apparatus having a separation means for separating and feeding originals one by one, and an image reading means for reading an image on the original separation by said separation means, said separation means comprising a plurality of separation portions provided in a perpendicular direction to the original supplying direction, wherein each separation portion includes (i) a plurality of rotary original supply means including a central, first and second portions, provided along the perpendicular direction and contact with a first surface of the original to feed the original in an original feeding direction and (ii) at least one rotary original return means disposed between adjacent said original supply means and contact with a second surface of the original to feed the original in an original returning direction, wherein one of said plurality of separation portions is disposed at a position corresponding to the central portion and other two of them are positioned at positions corresponding to the both ends of the original in the width-wise direction thereof:

wherein, in each separation portion, a force to supply an original by said sheet supply means is set greater than a force to return an original by said sheet return means; and wherein a difference between an original supplying force and an original return force at a central separation portion is selected to be greater than a corresponding difference for the both ends separation portions.

15. A sheet supplying apparatus having a sheet separation means for separating and feeding sheets one by one, said separation means comprises a plurality of separation portions provided in a direction perpendicular to the sheet supplying direction, wherein each separation portion includes (i) a plurality of rotary sheet supply means including a central, first and second portions, provided in the perpendicular direction and contact with a first surface of the sheet to feed a sheet in a feeding direction and (ii) at least one rotary sheet return means disposed between said adjacent sheet supply means to overlap with them in a sheet thickness direction and contact with a second surface of the sheet to feed the sheet in a returning direction, wherein one of said plurality of separation portions is disposed at a position corresponding to the central portion and two others are positioned at positions corresponding to the both ends, of the sheet in the width-wise direction thereof;

wherein, in each separation portion, a force to supply the sheet by said sheet supply means is set greater than a force to return the sheet by said sheet return means; and wherein an overlap amount between said sheet supply means and said sheet return means in said central separation portion is selected greater than that of the both sides, separation portions in the width-wise direction of the sheet.

16. An image reading apparatus comprising:

a sheet separation means for separating and feeding sheets one by one, and an image reading means for reading an image on the sheet, said separation means comprises a plurality of separation portions provided in a direction perpendicular to the sheet supplying direction, wherein each separation portion includes (i) a plurality of rotary sheet supply means provided in the perpendicular direction and contact with a first surface of the sheet to feed a sheet in a feeding direction and (ii) at least one rotary sheet return means disposed between said adjacent sheet supply means to overlap with them in a sheet thickness direction and contact with a second surface of the sheet to feed the sheet in a returning direction, wherein one of said plurality of separation portions is disposed at position corresponding to the central portion and two others are positioned at positions corresponding to the both ends, of the sheet in the width-wise direction thereof;

wherein, in each separation portion, a force to supply the sheet by said sheet supply means is set greater than a force to return the sheet by said sheet return means; and wherein an overlap amount between said sheet supply means and said sheet return means in said central separation portion is selected greater than that of the both sides, separation portions in the width-wise direction of the sheet.

* * * * *

UNITED STATES PATENT AND TRADEMARK OFFICE

CERTIFICATE OF CORRECTION

PATENT NO. : 5,833,230

DATED : November 10, 1998

INVENTOR(S) : TOMOHITO NAKAGAWA, ET AL.

It is certified that error appears in the above-identified patent and that said Letters Patent is hereby corrected as shown below:

COLUMN 9,
Line 25, "an" should read --a--.

COLUMN 12,
Line 15, "means" should read --means,--; and
Line 29, "wherein" should read --wherein,--.

COLUMN 13,
Line 42, "means" should read --means,--; and
Line 54, "thereof:" should read --thereof;--.

COLUMN 14,
Line 14, "means" should read --means,--.

Signed and Sealed this

Sixth Day of July, 1999

*Attest:*

Q. TODD DICKINSON

*Attesting Officer*

*Acting Commissioner of Patents and Trademarks*